United States Patent [19]

Smith et al.

[11] 4,066,217

[45] Jan. 3, 1978

[54] TAIL END GRIP MECHANISM

[75] Inventors: Robert E. Smith, Monte Sereno; Frank S. Chytil, Escondido, both of Calif.; George Feldstein; Dorman J. Swartz, both of Madison, N.J.

[73] Assignee: Allied Chemical Corporation, Morristown, N.J.

[21] Appl. No.: 704,009

[22] Filed: July 9, 1976

[51] Int. Cl.[2] ..... B65H 75/28

[52] U.S. Cl. ..... 242/25 R; 242/47; 242/125.2

[58] Field of Search ..... 242/47, 125.2, 19, 25 R, 242/25 A, 18 A, 18 R, 78, 54 R

[56] References Cited

U.S. PATENT DOCUMENTS

| | | | |
|---|---|---|---|
| 2,536,126 | 1/1951 | Dale | 242/125.2 |
| 2,583,933 | 1/1952 | Elder | 242/125.2 |
| 2,763,442 | 9/1956 | Bruestle | 242/25 A |
| 2,961,176 | 11/1960 | Swanson | 242/25 A |
| 2,961,177 | 11/1960 | Swanson | 242/25 A |

*Primary Examiner*—Stanley N. Gilreath

*Attorney, Agent, or Firm*—Arthur J. Plantamura; Ernest A. Polin

[57] ABSTRACT

An apparatus which grips the tail end of a rapidly traversing metal filament that has been wound onto a winding reel. The apparatus comprises a triggering means, which when actuated, pivots a grip lever that is mounted on the rotating reel support and locks the end of the advancing filament to the winding reel without interrupting the movement of either the filament or reel.

5 Claims, 4 Drawing Figures

TAIL END GRIP MECHANISM

BACKGROUND OF THE INVENTION

Various methods are known in the prior art for securing ends of filamentary material to a rotating storage reel or spool; however, no method is known for suitably gripping the tail end of a rapidly moving metal filament which travels at a rate often times at speeds in the order of 4000 to 6000 ft./min. and faster. With the manufacture of some types of filaments it is necessary to employ these high rates if the characteristics of the filament are to be retained. For example, the amorphous character of metal alloys such as those described in U.S. Pat. No. 3,856,513 require exceedingly high quench rates, i.e. in the order of many hundreds of degrees per second, to avoid substantial crystallinity in the composition. To retain the amorphous or glassy composition, it is necessary that the spun filament be quenched and processed at extremely high spinning rates. It is thus apparent that a need exists for an apparatus which is capable of grasping the trailing or tail end of a filament after it has been wound on a reel to prevent the wound filament from breakage, loosening or unraveling from the reel package due to centrifugal or other forces or due to inherent spring characteristic of the filament.

SUMMARY OF THE INVENTION

In accordance with the invention, especially when processing fine metal filament, after the filament has been wound in a normal manner unitl the reel is filled to the desired amount or when the filament supply is intentionally or inadvertently exhausted, or a break in the filament occurs, a tail end sensing device provides an electrical signal to a photoelectric device. An adjustable positioned indicator or flag positioned on the reel mounting assembly is interconnected in synchronization with the photoelectric device so as to function when the end of the filament in the train has been detected and to actuate a gripping element to grasp and hold the trailing end of the filament. The adjustable flag is positioned so that, after an appropriate time interval, the flag blocks the photoelectric light path and the resulting electrical impulse actuates the grip mechanism, which is fixed to the storage reel mounting hub, at an appropriate time to grip the filament tail end.

While variants in detail apparent to one skilled in the art may be utilized to implement the synchronization after the end of the filament is dectected, in the preferred arrangement the flag or indicator on the reel mounting blocks the photoelectric light path as the reel rotates and provides an electric signal to a triggering means such as a solenoid. The triggering means causes an actuator lever to extend or otherwise move and interrupt the path of a pivotal retaining element which is attached to the rotating storage reel mounting hub. The pivotal retaining element retains a grip lever in a locked position. When the grip lever is unlocked as a consequence of displacing the retaining element, the grip lever is forceably pivoted by a suitable actuating arrangement such as by the action of a torsion spring and grips the tail end of the filament and holds it securely contiguous to the rotating storage reel.

DESCRIPTION OF THE PREFERRED EMBODIMENTS

Figure 1:
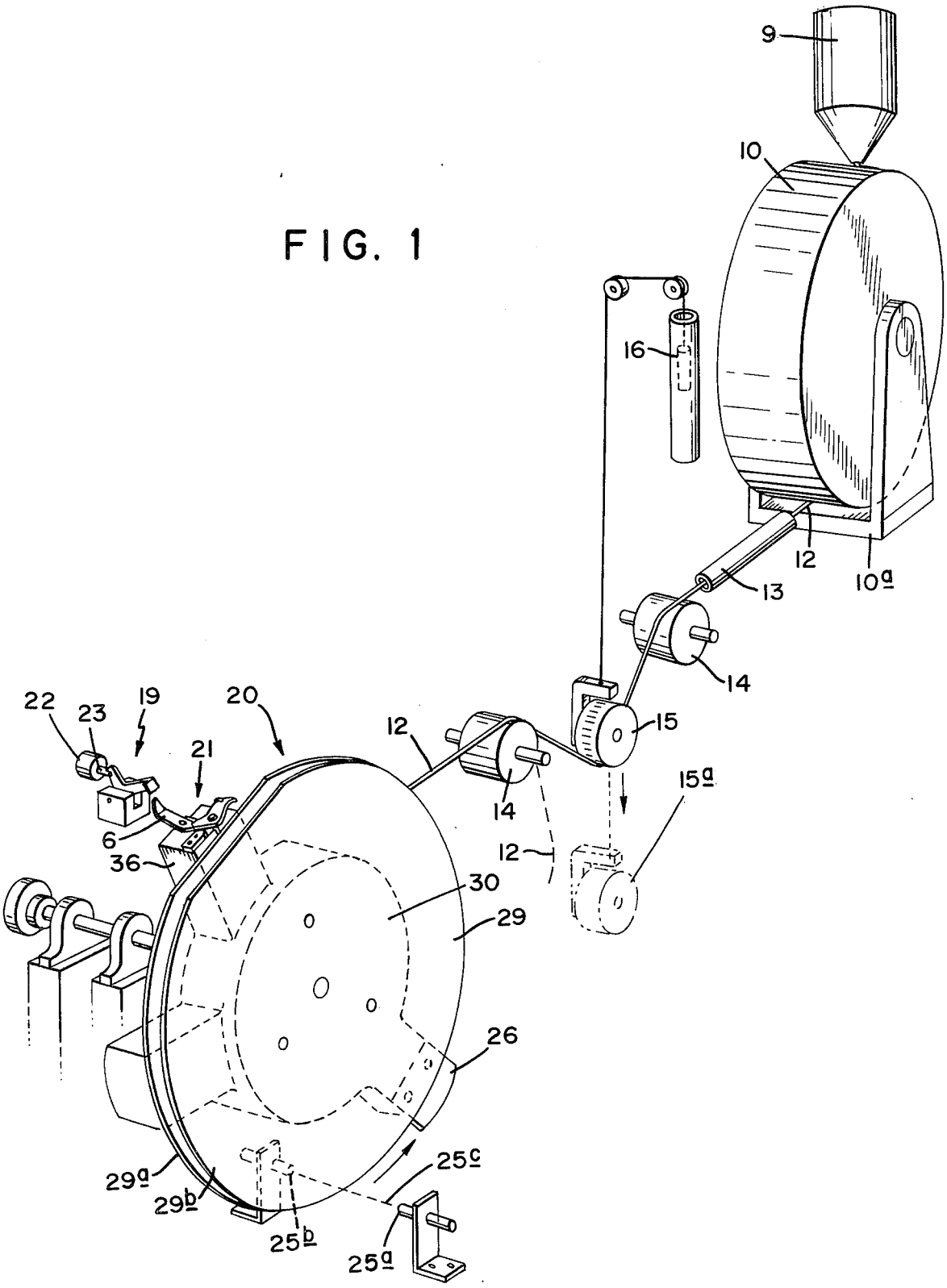
FIG. 1 is a perspective schematic representation of a system for production of a metal filament by quenching from a melt and in which the tail end grip mechanism apparatus of the invention comprises a part of the system.

Referring to the fingers of the drawings, the functionality and advantages of the invention are more fully illustrated. As shown in the schematic of FIG. 1 the essential features of the invention in its function of grasping the tail end of the metal filament as an integral part of a process of making metal filaments from molten metal will be described. It will be apparent, however, that the invention is not necessarily limited to use in a process of the kind described in conjunction with FIG. 1 but may be employed also in any system which involves rapid winding of filament on a reel or spool. As shown in the system schematic of FIG. 1, molten metal in reservoir 9 is extruded on a casting wheel or quench roller 10 which is suitably mounted on a support 10*a*. Upon solidification, the extrudate emerges as a filament or ribbon 12. The filament 12 is thereafter suitably transferred, optionally processed such as by drawing and/or reheated and wound on a reel 29. As illustrated, the filament 12 is passed through a guide means 13 and a tension control arrangement. The tension control arrangement may comprise any appropriate device and, as shown, includes in combination fixed rotating guide rollers 14, and a vertically movable "dancing" roller 15 which is coordinated with a counter-balancing means 16. The vertically movable self-adjusting dancing roller 15 and the counter-balancing means 16 are responsive to the amount of slack in the filament 12 and, upon being set with a preadjusted tension, adjust vertically to maintain an essentially uniform tension in the filament 12 that is being formed from the molten melt from molten metal reservoir 9. The dancing roller 15 and counter-balancing means 16 may comprise any sutiable tension responsive arrangement which is capable of providing essentially constant tension in the filament 12 such as that disclosed, for example, in U.S. Pat. No. 3,831,412.

The filament 12 is fed to a winding arrangement 20 which incorporates the tail end gripping means 21 and a reel mounting assembly 30 which receives the reel 29. The tail end gripping means 21 which forms the essence of the invention functions to grasp the tail end of the rapidly advancing filament 12 and secure it contiguous to the reel 29 by means of a gripping lever 17 which is a part of the gripping means 21 after the filament 12 has been wound on the reel 29.

Figure 2:
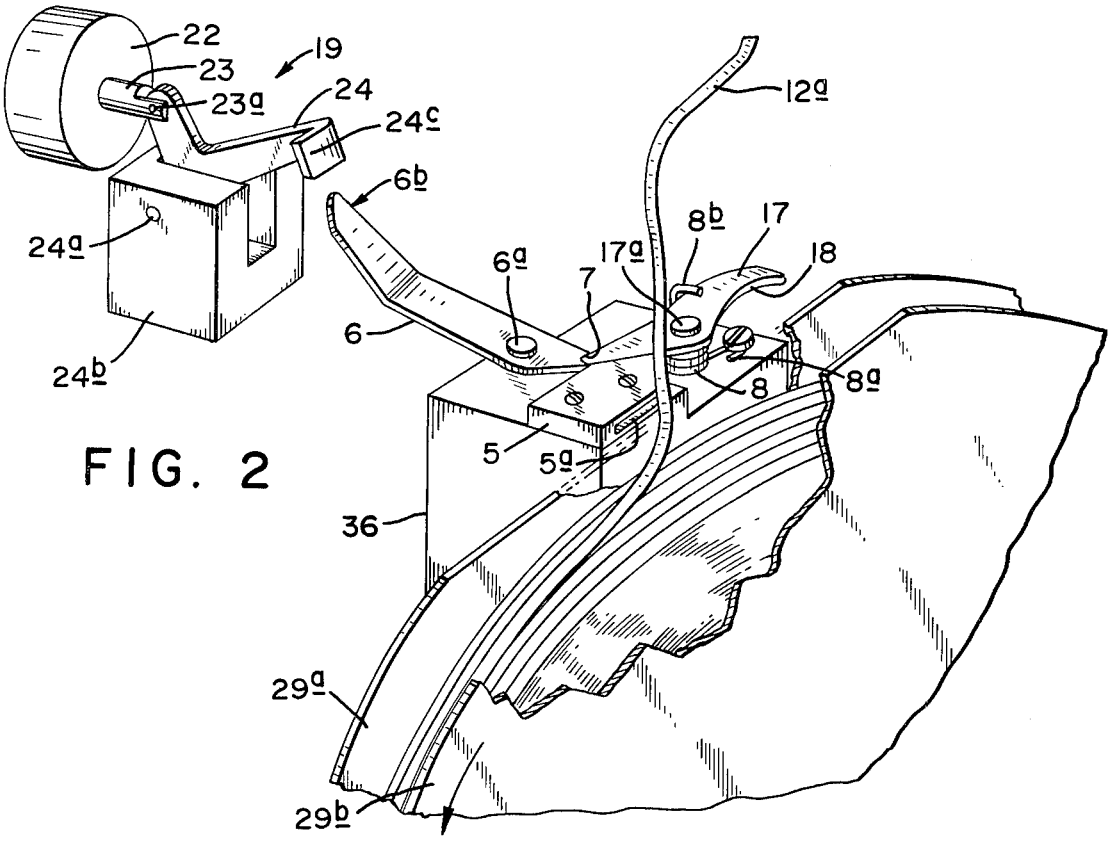
FIG. 2 is a fragmentary representation of the tail end grip mechanism of the invention illustrated in the locked position.
Figure 3:
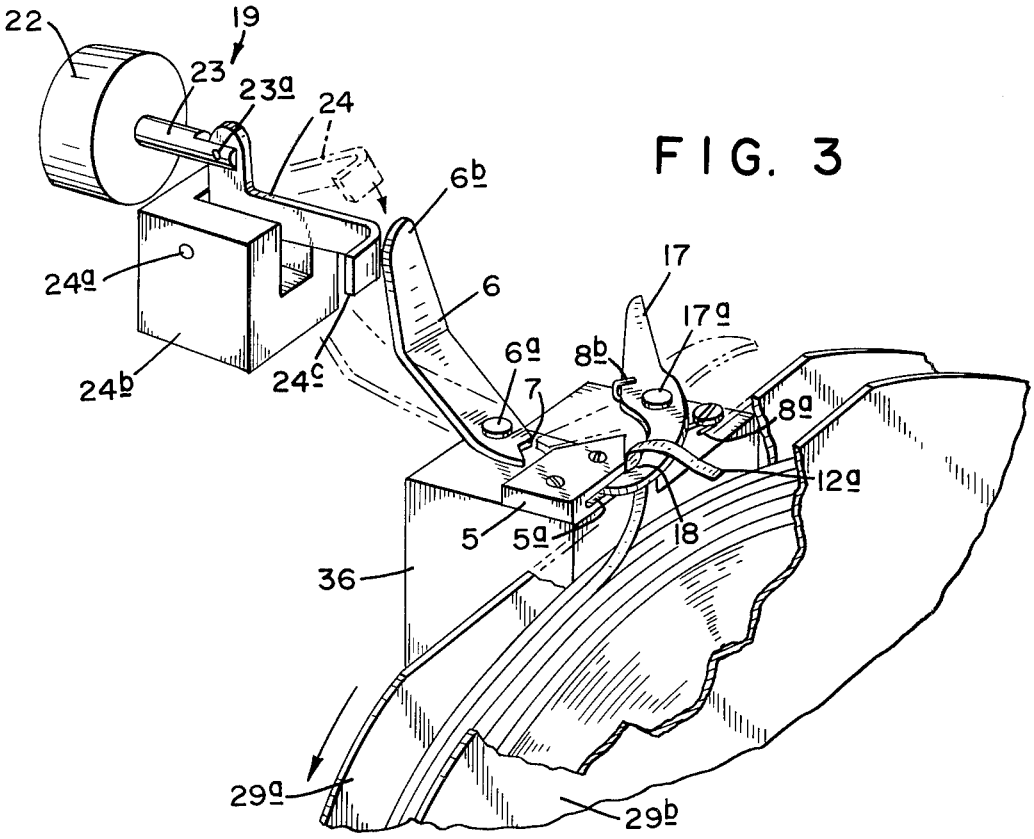
FIG. 3 is another fragmentary representation of the tail end grip mechanism of the invention showing the mechanism in a position after the tail end of the filament has been gripped and locked to the rotating storage free hub.
Figure 4:
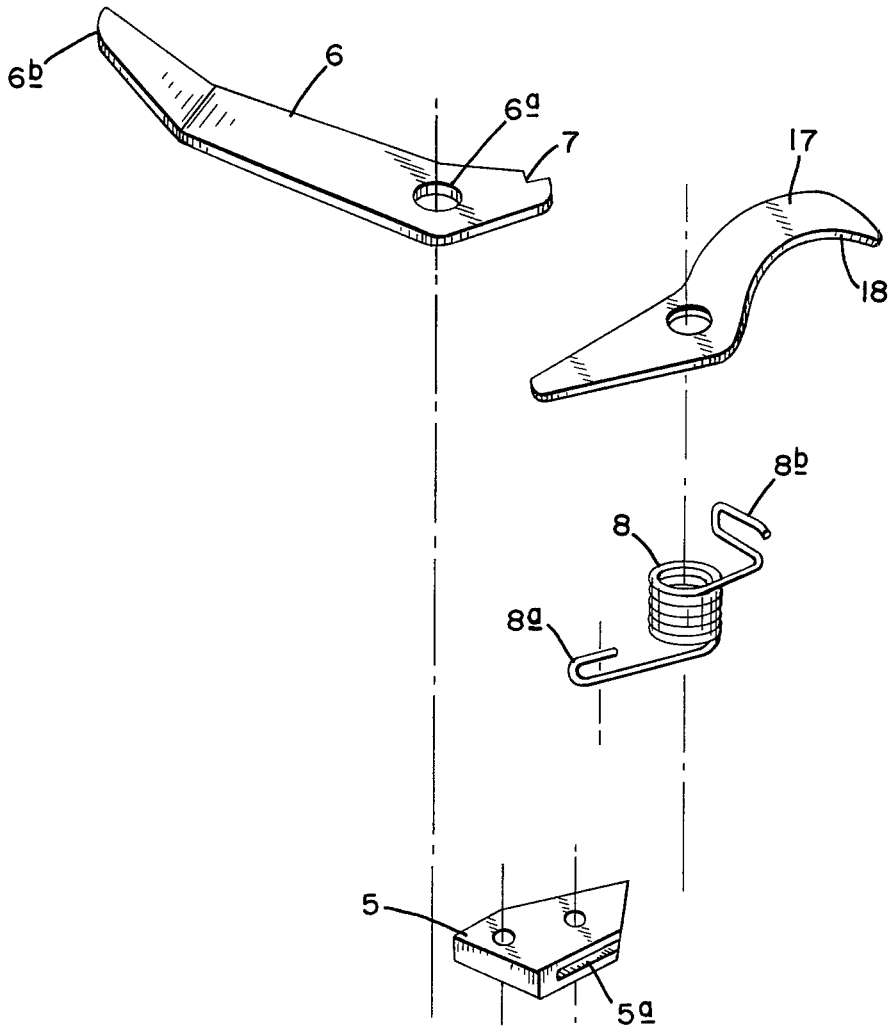
FIG. 4 is an enlarged exploded representation showing the elements of the gripping device, i.e. the retainer or lock, the gripping finger, the actuator element, and the gripping pad.

The gripping means 21 of the invention is described in greater detail by reference to FIGS. 2 thru 4 of the drawing. As shown in FIGS. 2 and 3, a filament tail end 12*a* is positioned next to the gripper pad 5 which is preferably formed of a resilient material such as hard rubber or filled phenolic resin. The tail end gripping means 21 comprises in addition to the gripper pad 5, a locking element 6, a gripping lever 27 and spring 8. The locking element 6 is pivotally mounted at 6*a* on the support 36 and, as shown in FIG. 2, serves at one end 7 provided with an indentation to hold or lock the gripping lever 17 in the loaded position against the force of the spring 8. The gripping lever 17 is formed on one side with a gripping edge 18. The spring 8 is secured at the support 36 at one end 8*a* and is secured at the other end 8*b* on the gripping lever 17 which is pivotally mounted at 17*a*. A suitable triggering mechanism is shown at 19 which may comprise any suitable arrangement for remotely actuating the tail end grip mechanism. The triggering mechanism 19 which is illustrated comprises a solenoid 22, a solenoid shaft 23 and an actuating element 24 which is pivotally attached at 24*a* and at 23*a* and on support 24*b*. Suitable means such as a photoelectric detector 25*b* as illustrated in FIG. 1 may be used to sense the proper point at which the triggering mechanism 19 may be actuated.

The tail end gripping device of the invention essentially operates in the following manner:

At a suitable point in time, after the filament has been wound on the reel 29 and the tail end 12*a* of the filament 12 in the upstream sequence has passed beyond the dancing roller 15, the dancing roller 15, being unsupported by the filament, will drop to a lower position shown at 15*a* in FIG. 1. When the dancing roller 15 is in this lowered (15*a*) position a suitable sensing device is activated, such as to produce a signal to the triggering mechanism 19. As shown, a conventional photoelectric device, comprising a light source 25*a* and a photoelectric detector 25*b*, is energized electrically by a switching means (not shown) which is interconnected with dancing roller 15. A flag 26 or alternatively other suitable element which is mounted on the reel mounting assembly 30 and functions to block the light path 25*c* of the now activated circuit, electrically energizes the solenoid 22. The flag 26 may be relatively adjusted, e.g. as by relative rotation, on the reel mounting assembly 30 so that actuation of the triggering mechanism 19 is suitably synchronized with the position of the tail end 12*a* of the filament 12. The solenoid shaft 23 when activated is extended, thereby pivoting actuating element 24 downward so that the end 24*c* thereof contacts the extremity 6*b* of the locking element 6. Locking element 6 is pivoted at 6*a* and, at its opposite end, locks the gripping lever 17 in the indentation provided at end 7 thereof this holds the gripping lever 17 against the force of the coiled spring 8. When the lock at 7 is disengaged by movement of locking element 6 through the action of the actuating element 24 on the end 6*b* of locking element 6, the gripping lever 17 is pivoted so that its free end 18 enters into recess 5a formed in the gripper pad 5. This has the effect of securely gripping the tail end 12*a* of the filament 12 between the gripping edge 18 of gripping lever 17 and gripper pad 5. It is apparent that the tail end gripping functions at any time that support for the dancing roller 15 is withdrawn or it may be made to occur after the winding has progressed and the desired amount of filament is stored on the reel 29 between the reel faces 29*a* and 29*b* or by a suitable hand switch (not shown) when the filament winding is transferred to a replacement reel. In the latter instance, the filament is cut in a suitable manner, the trailing end is caught by the gripping lever 17 as described above, and the advance end of the cut filament is fed to a fresh storage reel such as through the cut and grip mechanism disclosed in our commonly assigned copending U.S. Patent application Ser. No. 703,715, filed on July 9, 1976. It will be understood that various modifications of the invention herein disclosed may be made without departing from the spirit and scope of the invention as defined by the claims appended hereto. 9n

1. An apparatus for gripping and retaining the tail end of a moving filament contiguous to a rotating storage reel comprising in combination:

a. a rotable reel mounting assembly for receiving said reel;

b. a pivotal gripping means mounted on said reel mounting assembly adapted to be remotely actuated to grip the tail end of the filament which is stored on a reel carried on said reel mounting assembly;

c. sensing means adapted to detect passage of the tail end of the filament and to generate a signal responsive to such passage;

d. triggering means in circuit with said sensing means adapted to actuate said pivotal gripping means to grip the tail end of the filament responsive to the signal generated by said sensing means.

2. The apparatus of claim 1 wherein said triggering means (d) comprises a solenoid.

3. The apparatus of claim 1 wherein said triggering means (d) comprises a solenoid in combination with a photoelectric detector.

4. The apparatus of claim 1 wherein said pivotal gripping means (b) comprises a pivotal lever.

5. The apparatus of claim 3 wherein said solenoid actuates an intermediate lever and wherein said gripping means (b) is held in a cocked position against the force of a spring by a releasable retainer and wherein said retainer is released when the solenoid actuates said intermediate lever.

* * * * *

UNITED STATES PATENT AND TRADEMARK OFFICE

CERTIFICATE OF CORRECTION

PATENT NO. : 4,066,217

DATED : January 3, 1978

INVENTOR(S) : R. Smith; F. Chytil; G. Feldstein and D. Swartz

It is certified that error appears in the above-identified patent and that said Letters Patent are hereby corrected as shown below:

Column 3, line 1 "27" should read -- 17 --.

Column 3, line 48, after "thereof" insert -- ; --.

Column 4, line 21, delete "9n".

Column 4, insert -- We claim: -- between lines 21 and 22.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*